US009573722B1

(12) United States Patent
Capogrosso

(10) Patent No.: US 9,573,722 B1
(45) Date of Patent: Feb. 21, 2017

(54) CARTON WITH CORNER CRUMPLE ZONES

(71) Applicant: Green Bay Packaging, Inc., Green Bay, WI (US)

(72) Inventor: Andrew M. Capogrosso, Fremont, OH (US)

(73) Assignee: Green Bay Packaging, Inc., Green Bay, WI (US)

( * ) Notice: Subject to any disclaimer, the term of this patent is extended or adjusted under 35 U.S.C. 154(b) by 23 days.

(21) Appl. No.: 14/288,916

(22) Filed: May 28, 2014

Related U.S. Application Data

(60) Provisional application No. 61/827,882, filed on May 28, 2013.

(51) Int. Cl.

| | |
|---|---|
| ***B65D 81/02*** | (2006.01) |
| ***B65D 81/17*** | (2006.01) |
| ***B65D 5/50*** | (2006.01) |
| ***B65D 81/05*** | (2006.01) |
| ***B65D 5/42*** | (2006.01) |
| ***B65D 5/44*** | (2006.01) |
| ***B65D 85/64*** | (2006.01) |

(52) U.S. Cl.
CPC ..... *B65D 5/50* (2013.01); *B65D 5/4266* (2013.01); *B65D 5/445* (2013.01); *B65D 81/053* (2013.01); *B65D 85/64* (2013.01); *B65D 5/42* (2013.01)

(58) Field of Classification Search
CPC ..... B65D 81/02; B65D 81/025; B65D 81/107; B65D 5/745
USPC ..... 206/320, 586, 591, 592, 521; 229/152, 229/154, 193, 939
See application file for complete search history.

(56) References Cited

U.S. PATENT DOCUMENTS

| | | | | | |
|---|---|---|---|---|---|
| 987,958 | A * | 3/1911 | Clenny | B65D 5/58 | 206/521 |
| 1,585,684 | A * | 5/1926 | Oppenheim | B65D 5/505 | 206/521 |
| 1,758,230 | A * | 5/1930 | Lange | B65D 5/4266 | 229/930 |
| 2,654,525 | A * | 10/1953 | Adorney | B65D 5/541 | 229/215 |
| 2,808,978 | A * | 10/1957 | Wright | B65D 5/505 | 206/320 |
| 2,887,263 | A * | 5/1959 | Wright | B65D 5/12 | 206/320 |
| 2,949,151 | A * | 8/1960 | Goldstein | D21J 1/00 | 156/207 |
| 2,960,217 | A * | 11/1960 | Nason | B65D 5/5033 | 206/320 |
| 3,029,994 | A * | 4/1962 | Chapman | B65D 5/12 | 206/320 |
| 3,100,072 | A * | 8/1963 | Mason | B65D 5/443 | 229/199 |
| 3,126,144 | A * | 3/1964 | McCulloch | B65D 5/5033 | 206/521 |
| 3,175,749 | A * | 3/1965 | Elias | B65D 5/74 | 229/104 |

(Continued)

*Primary Examiner* — J. Gregory Pickett
*Assistant Examiner* — Gideon Weinerth
(74) *Attorney, Agent, or Firm* — Boyle Fredrickson, S.C.

(57) ABSTRACT

A shipping carton having a force receiving area located adjacent opposing edges of the carton's top and bottom edges. The force receiving area is configured to deform in the presence of an external force and distribute that force through the force receiving area while minimizing the transfer of force directly to the appliance and minimizing damage to the surface panels of the shipping carton.

16 Claims, 10 Drawing Sheets

(56) References Cited

U.S. PATENT DOCUMENTS

| | | | | | |
|---|---|---|---|---|---|
| 3,199,763 | A * | 8/1965 | Anderson | B65D 5/4266 | 229/126 |
| 3,504,842 | A * | 4/1970 | Grafslund | B65D 85/64 | 206/320 |
| 3,734,389 | A * | 5/1973 | Brown | B65D 81/054 | 206/320 |
| 3,891,086 | A * | 6/1975 | Isaacs | B65D 75/004 | 206/320 |
| 3,981,430 | A * | 9/1976 | Keim | B65D 5/745 | 229/215 |
| 4,081,124 | A | 3/1978 | Hall | | |
| 4,117,929 | A * | 10/1978 | VanderMey | B65D 5/5035 | 206/326 |
| 4,134,497 | A * | 1/1979 | Dlugopolski | B65D 5/5038 | 206/521 |
| 4,221,294 | A * | 9/1980 | Burgess | B65D 5/28 | 206/521 |
| 4,483,444 | A * | 11/1984 | Gardner | B65D 81/05 | 206/320 |
| 4,811,840 | A | 3/1989 | Muyskens | | |
| 5,669,496 | A * | 9/1997 | Daniels | B65D 77/24 | 206/320 |
| 6,357,587 | B1 * | 3/2002 | Melms, Jr. | B65D 85/64 | 206/320 |
| 6,578,346 | B1 | 6/2003 | Sowa | | |
| 6,988,615 | B2 | 1/2006 | Merkel et al. | | |
| 7,228,965 | B2 * | 6/2007 | Marventano | B65B 67/08 | 206/320 |
| 7,661,579 | B2 * | 2/2010 | Kruelle | B65D 5/4266 | 229/122.34 |
| 7,832,623 | B1 * | 11/2010 | Capogrosso | B65D 5/02 | 229/125 |
| 7,882,956 | B2 * | 2/2011 | McDonald | B65D 5/5059 | 206/583 |

* cited by examiner

CARTON WITH CORNER CRUMPLE ZONES

CROSS-REFERENCE TO RELATED APPLICATION

This application claims the benefit of U.S. Ser. No. 61/827,882 filed May 28, 2013, the disclosure of which is incorporated herein in its entirety.

FIELD. OF THE INVENTION

The present invention relates to a shipping carton and, more particularly a shipping carton having integrated crumple zones for accepting lateral forces exerted on the carton during transportation.

BACKGROUND OF THE INVENTION

Large consumer appliances such as washing machines, dryers, dishwashers, ranges, freezers and refrigerators are typically packaged in individual cartons during their transportation from the manufacturer to the retailer, and ultimately to the end purchaser. The use of a carton is important in protecting the exterior of the appliance from potential damage, such as scratching and chipping the finish or even denting the appliance body. Conventional home appliance cartons are formed of one or more pieces of packaging material that form a six sided cuboid box surrounding the appliance. Due to the size and shape of these appliances, as well as the large quantity in which they are manufactured, they are typically shipped without being palletized. Accordingly, rather than use a forklift or similar lift truck to move the cartons, it is often more efficient to use a clamping lift truck that braces one or more cartons simultaneously with opposing lateral clamp arms.

However, the use of a clamping lift truck to lift and move appliance cartons can result in undesirable damage to the carton. In this regard, the opposing lateral forces exerted on the carton's side, from the clamps arms, compress the carton and transfer forces to the top and bottom of the carton, which are made up of folded and interconnected top and bottom flaps. These compressive forces are transmitted along the top and bottom corners of the carton at the front and the rear of carton, which can buckle to form a vertical crease along the front and/or rear panels of the carton. Typically this crease appears along the center of the carton and is visually unattractive. In some instances, this crease extends inwardly and can even contact the appliance contained therein, resulting in undesirable physical and esthetic damage to appliance.

An appliance carton typically includes L-shaped corner posts located between the carton wall and the appliance. These posts, which are typically made of a relatively stiff packaging material, assist in protecting the corners of the appliance and also provide sufficient strength to enable the cartons to be stacked. However, the corner posts also act to transfer the lateral clamping forces to the top and bottom of the carton, resulting in the crease mentioned above.

The present invention solves the aforementioned drawbacks by providing a shipping carton that includes an integrated corner crumple zone for accepting lateral forces exerted on the carton during handling and preventing transfer of the lateral clamping forces to the top and bottom corners of the carton. The present invention provides a carton that is particularly well suited for use in shipping appliances, but may also be beneficial for other shipping and distribution needs, including the shipment of products that have low tolerances to shipping related damage.

SUMMARY OF THE INVENTION

In one aspect, the present invention provides a shipping carton formed from a single blank or sheet of material, having a force receiving area located adjacent opposing edges of the carton's top and bottom edges. Each force receiving area is configured to deform in the presence of an external force and distribute that force through the force receiving area while minimizing the transfer of force directly to the appliance and minimizing deformation of the surface panels of the shipping carton.

In another aspect, the invention provides a dual layer top and bottom portion of the carton, where the force receiving areas of the top and bottom portions functionally cooperate.

In another aspect, the invention provides the force receiving areas of the top and bottom portions located at a position removed from the edge of the carton equal to a width of a support structure located within the carton, between the appliance and the carton.

In yet another aspect, the invention provides voids in at least one layer of the top and bottom of the carton configured to localize damage to the carton in the vicinity of the voids.

BRIEF DESCRIPTION OF THE DRAWINGS

The drawings illustrate a representative embodiment presently contemplated for carrying out the present invention. It should be understood that the invention is not limited to the embodiments disclosed, and is capable of variations within the scope of the appended claims.

In the Drawings.

DETAILED DESCRIPTION

I. Embodiment One

Figure 1:
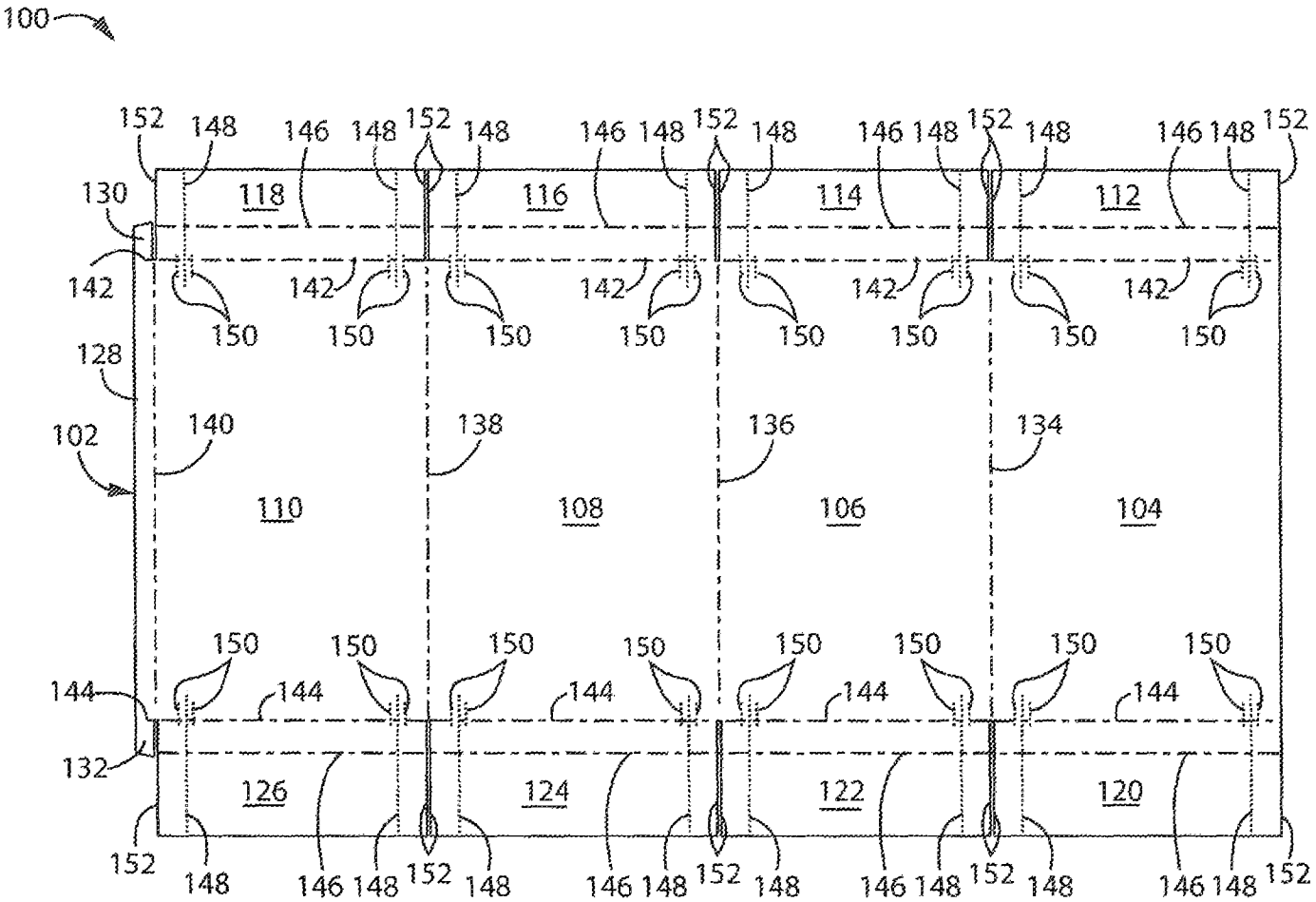
FIG. 1 is a top plan view of an unfolded blank of a container, according to one aspect of the present invention.

Referring initially to FIGS. 1-4 and particularly FIG. 1, there is shown a shipping carton 100 according to one embodiment of the present invention. The shipping carton 100 generally is made of a sheet or blank 102 of packaging material. The packaging material may consist of corrugated board or any similar material suitable for use in shipping container construction. In a manner as is known, the corrugated board consists of a fluted corrugated core located between two sheets of kraft paper or linerboard, in a manner as is known. In one embodiment the flutes of the inner core have a longitudinal axis that is parallel to the longitudinal axis of the folded and erected carton 100. The blank 102 may be stamped or cut from a sheet of the packaging material while in a substantially flat orientation, and subsequently folded to form the carton 100. The outer surface of the carton 100 may be printed to display information such as contents details, shipping information, removal instructions, orientation indicia and the like. The outer surface of the carton 100 may also contain advertising information or ornamental elements.

FIG. 1 illustrates the blank 102, formed of a single piece of packaging material, in a flat orientation. The blank 102 includes primarily a first side panel 104, a front panel 106, a second side panel 108 and a rear panel 110. Each of these four panels 104, 106, 108, 110 also includes respective individual top panels 112, 114, 116, 118 and individual bottom panels 120, 122, 124, 126 extending from the top and bottom of each corresponding panel 104, 106, 108, 110. Lastly, the rear panel 110 also includes a fixation panel 128, extending from a side of the rear panel 110 between the top panel 118 and bottom panel 126. As illustrated in FIG. 1, the fixation panel 128 may have a small top panel 130 and bottom panel 132 extending from the top and bottom of the fixation panel 128, in line with the other top panels 112, 114, 116, 118 and bottom panels 120, 122, 124, 126 respectively.

Still referring to FIG. 1, the first side panel 104 is hingedly attached to the front panel 106 about a crease line 134. The opposing side of the front panel 106 is hingedly attached to the second side panel 108 about a crease line 136. The opposing side of the second side panel 108 is hingedly attached to the rear panel 110 about a crease line 138, and the opposing side of the rear panel 110 is hingedly attached to the fixation panel 128 about a crease line 140. As illustrated in FIG. 1, the crease lines 134, 136, 138, 140 are parallel in orientation, allowing the panels 104, 106, 108, 110, 128 to be folded into a cuboid carton 100 as is described in further detail below.

In addition to the above indicated side crease lines 134, 136, 138, 140 the blank 102 also includes a top crease line 142 and a bottom crease line 144. The top crease line 142 extends along the upper side or edge of each panel 104, 106, 108, 110, 128 and hingedly attaches the top panels 112, 114, 116, 118, 130 respectively thereto. Similarly, the bottom crease line 144 extends along the lower side or edge of each panel 104, 106, 108, 110, 128 and hingedly attaches the bottom panels 120, 122, 124, 126, 132 respectively thereto. The top and bottom crease lines 142, 144 are each formed of a continuous crease that extends the entire length of the blank 102, and form upper and lower edges of the erected carton 100, when folded. While the lines 134, 136, 138, 104, 142, 144 have been described as "crease lines", it is well within the scope of the invention that these lines may be formed of other methods, including but not limited to scoring or perforating.

Still referring to FIG. 1, the top and bottom panels 112, 114, 116, 118, 120, 122, 124, 126, 130, 132 will be described in further detail. As illustrated in FIG. 1, each of the top panels 112, 114, 116, 118 and bottom panels 120, 122, 124, 126 includes a similar pattern of crease lines and perforations, collectively referred to as a crumple zone described below. Specifically, each top and bottom panel 112, 114, 116, 118, 120, 122, 124, 126, includes a crumple zone crease line 146. The crumple zone crease line 146 is located adjacent the respective crease line 142, 144 and on the surface of the top or bottom panel 112, 114, 116, 118, 120, 122, 124, 126. In the illustrated embodiment, the crumple zone crease line 146 may be located approximately between 0.5 and 5.0 inches from the respective top or bottom crease line 142, 144 and approximately 3.25 inches from the respective top or bottom crease line 142, 144. While the crumple zone crease line 146 had been described as "crease lines", it is well within the scope of the invention that this line 146 may be formed of other methods, including but not limited to scoring or perforating.

In addition to the crumple zone crease line 146, each top and bottom panel 112, 114, 116, 118, 120, 122, 124, 126 also includes at least one primary crumple zone perforation line 148, and may include one or more secondary crumple zone perforation lines 150. The primary crumple zone perforation line 148 and secondary crumple zone perforation lines 150 are oriented perpendicular to the crumple zone crease line 146. In the illustrated embodiment in FIG. 1, the blank 102 includes two secondary crumple zone perforation lines 150 for ever primary crumple zone perforation line 148, with the secondary crumple zone perforation lines 150 being short lines located on opposing sides of the primary crumple zone perforation line 148. As shown in FIG. 1, the primary crumple zone perforation line 148 may be located approximately between 0.5 and 5.0 inches from the respective side edge 152 of the corresponding top or bottom panel 112, 114, 116, 118, 120, 122, 124, 126, and approximately 3.25 inches from the side edge 152 of the corresponding top or bottom panel 112, 114, 116, 118, 120, 122, 124, 126. Accordingly, in a folded configuration as will be described in further detail below, the primary crumple zone perforation line 148 will overlie crumple zone crease line 146. Again, while the primary crumple zone perforation line 148 and secondary crumple zone perforation lines 150 have been described as "perforation lines", it is well within the scope of the invention that these lines 148, 250 may be formed of other methods, including but not limited to scoring or creasing.

Figure 2:
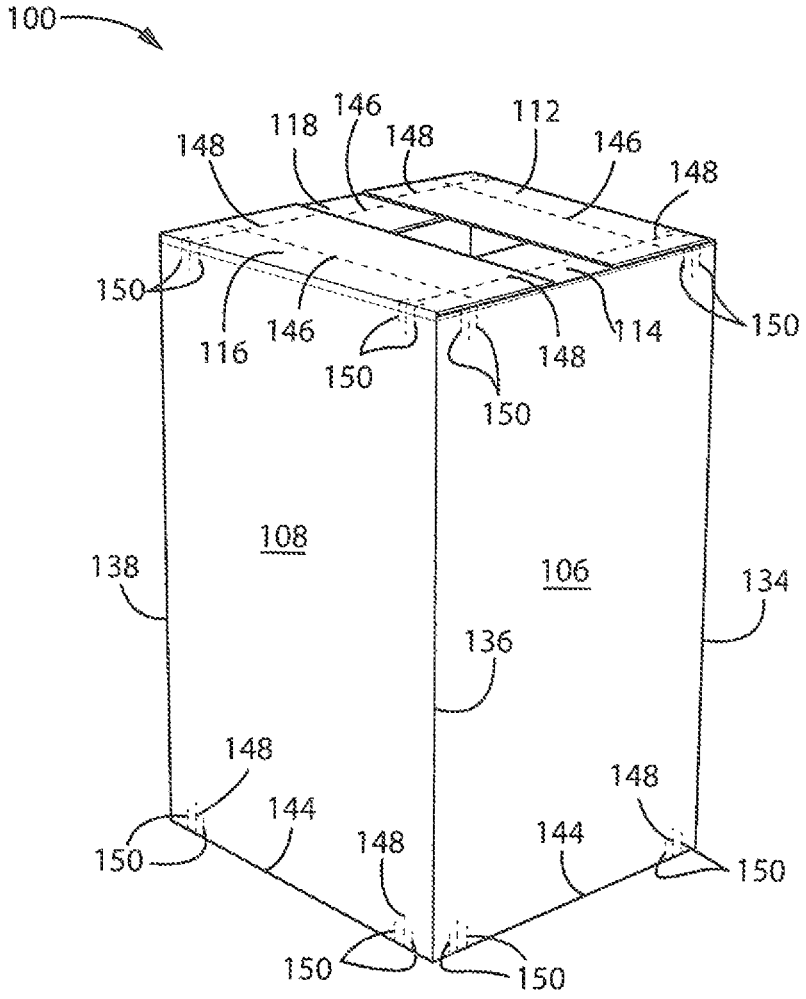
FIG. 2 is a perspective view of a folded container that is formed using the blank of FIG. 1, showing the container in a closed configuration.
Figure 3:
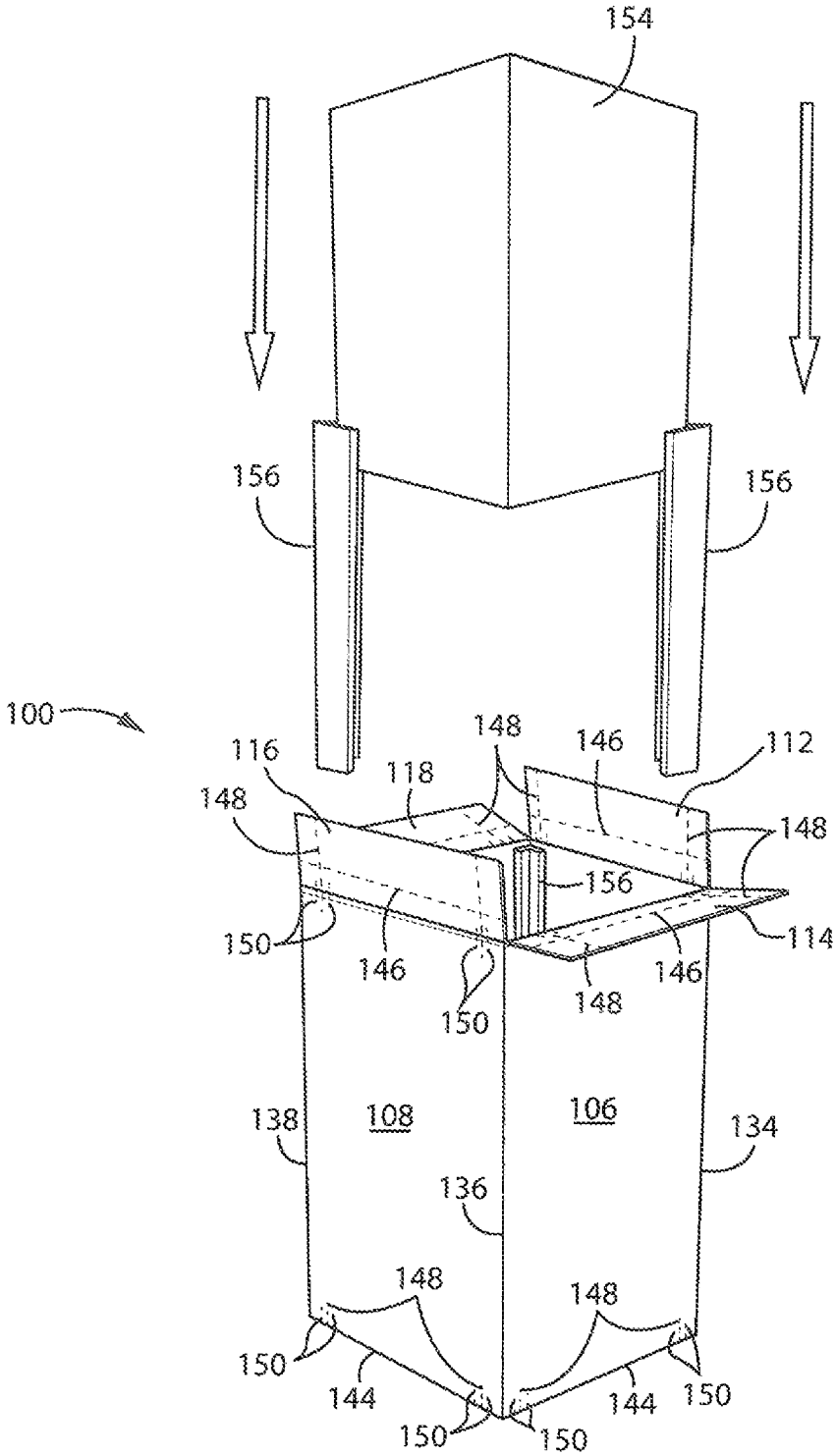
FIG. 3 is an exploded perspective view of the folded container of FIG. 2 with the container in an open configuration receiving a plurality of corner posts and a home appliance therein.

Turning now to FIGS. 2 and 3, the blank 102 will be described in a folded and erected configuration to form carton 100. The blank 102 is folded approximately 90 degrees around the score lines 134, 136, 138, 140 until the outer surface of fixation panel 128 overlaps with the inner surface of the first side panel 104. The blank 102 is then retained in this folded configuration by means of applying adhesive between the outer surface of fixation panel 128 and the inner surface of the first side panel 104. Alternatively, the fixation panel 128 and first side panel 104 may be retained in their folded configuration by means of fasteners such as staples, adhesive tape or any other known means of fixation. The bottom panels 120, 122, 124, 126, 132 are then folded inwardly, approximately 90 degrees around crease line 144 respectively to form a base of support on which the carton 100 rests. Once the bottom panels 120, 122, 124, 126, 132 have been folded they may be adhesively or alternatively fixed together to form an integrated base. The outer surfaces of bottom panels 122, 126 may be adhesively affixed to the inner surfaces of bottom panels 120, 124; or alternatively the outer surfaces of bottom panels 120, 124 may be adhesively affixed to the inner surfaces of the bottom panels 122, 126. As shown in FIG. 3, after the bottom has been formed, an appliance 154 or other object may be inserted into the interior cavity formed within the carton 100. Corner posts 156 and or other packaging materials may also be inserted into the carton 100, surrounding the appliance 154. The width of the corner posts 156 is representatively approximately equal to the distance from the crumple zone crease line 146 to the corresponding crease line 142, 144 as well as the primary crumple zone perforation line 148 to the side edge 152. Once all of the contents have been placed into the carton 100, the top panels, 112, 114, 116, 118, 130 may be folded inwardly, approximately 90 degrees around crease line 142 respectively to form a top to the carton 100 and adhesively or alternatively fixed together. As shown in FIG. 2 the inner surfaces of top panels 112, 116 may be adhesively affixed to the outer surfaces of top panels 114, 118; or alternatively the inner surfaces of top panels 114, 118 may be adhesively affixed to the outer surfaces of the top panels 116, 120.

Figure 4:
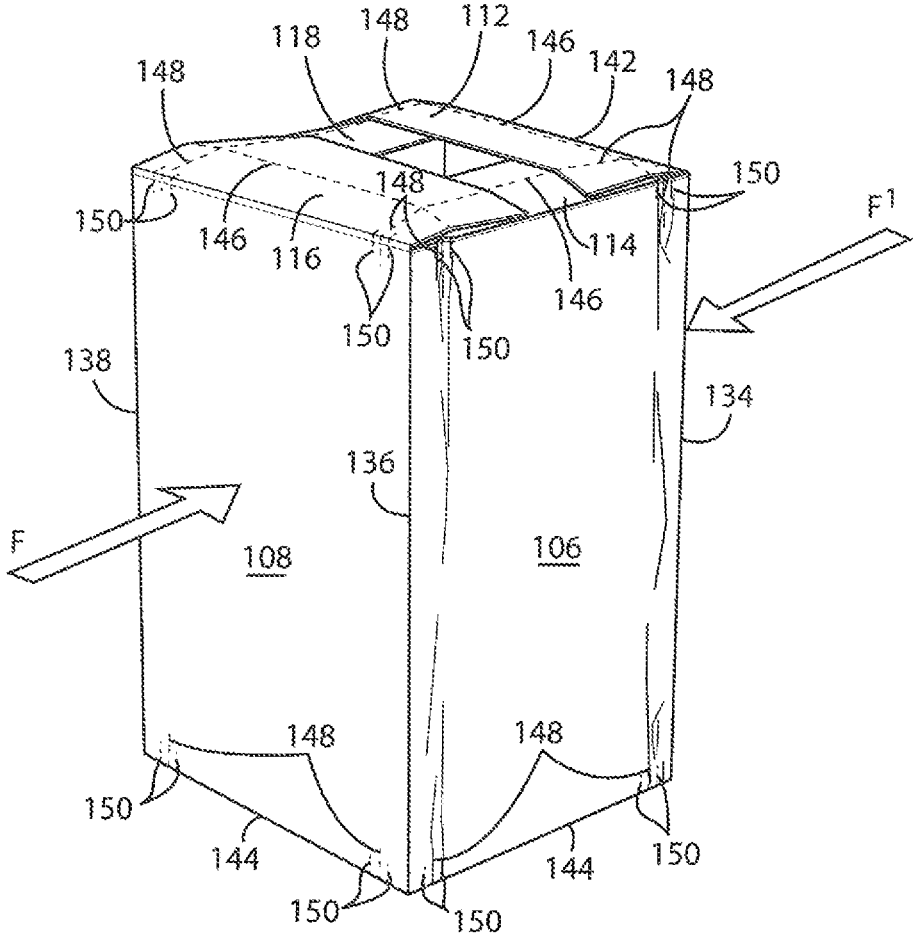
FIG. 4 is a perspective view of the folded container of FIG. 2 showing the container in a closed configuration receiving an inwardly directed lateral force on opposing side walls, such as is experienced during clamping-type load handling, resulting in a controlled crumpling at select positions along the container walls and buckling of the container top and bottom.

Turning now to FIG. 4, once the carton 100 has been retained in its folded configuration described above, it may be subjected to opposing lateral forces such as those exerted by a clamp lift and indicated by arrows F, F'. When subjected to such forces, the first and second side panels 104, 108 may be forced inwards, in the direction indicated by arrows F, F'. In response to such inward movement of the first and second side panels 104, 108, the forces applied to the first and second side panels 104, 108 are transferred to the weakened crumple zone crease line 146, primary crumple zone perforation line 148, and one or more secondary crumple zone perforation lines 150, rather than directly to the front and rear panels 106, 110 and the top and bottom of carton 100. This avoids buckling at the top and bottom corners of the front and rear panels 106, 110 and instead results in upward and downward flexing, bending, and movement at crumple zone crease line 146, primary crumple zone perforation line 148, and one or more secondary crumple zone perforation lines 150 at the top and bottom of the carton 100, respectively.

Still referring to FIG. 4, the crumple zone crease line 146, primary crumple zone perforation line 148, and one or more secondary crumple zone perforation lines 150 are illustrated in a crumpled configuration in which a lateral force F has forced the second side panel 108 inwards, resulting in the vertical flexing or bending of the crumple zone at crease line 146, primary crumple zone perforation line 148, and one or more secondary crumple zone perforation lines 150 so as to absorb or receive the force F and thereby limit the carton 100 from undesirably and uncontrollably creasing or bending in other locations. The inward movement of the second side panel 108 is transitioned to upward bowing of the top of the carton 100, downward bowing of the bottom of the carton 100, and outward bowing of the front and rear panels 106, 110. That is to say that the crumple zone crease line 146, primary crumple zone perforation line 148, and one or more secondary crumple zone perforation lines 150, in combination with the underlying corner posts 156 act as a relief to insure that lateral movement of the upper end of second side panel 108 does not result in application of a lateral force to the top corner of carton 100. That is, the presence of the crumple zone crease line 146, primary crumple zone perforation line 148, and one or more secondary crumple zone perforation lines 150 will localize any potential creasing of carton 100 to the area of the carton 100 that is in the approximate vicinity of the crumple zone crease line 146, primary crumple zone perforation line 148, and one or more secondary crumple zone perforation lines 150. By way of localizing the potential creasing of carton 100, as is illustrated in FIG. 4, the front and rear panels 106, 110 do not exhibit creasing or alternative damage, particularly around the center or middle of the carton 100. As a result, the carton 100 has an improved esthetic appearance after shipment. Additionally, by localizing any potential creasing or carton 100 to an area adjacent a corner post, the present invention greatly reduces the risk of abrading, scratching and chipping the finish of the appliance or denting the appliance body.

II. Embodiment Two

Figure 5:
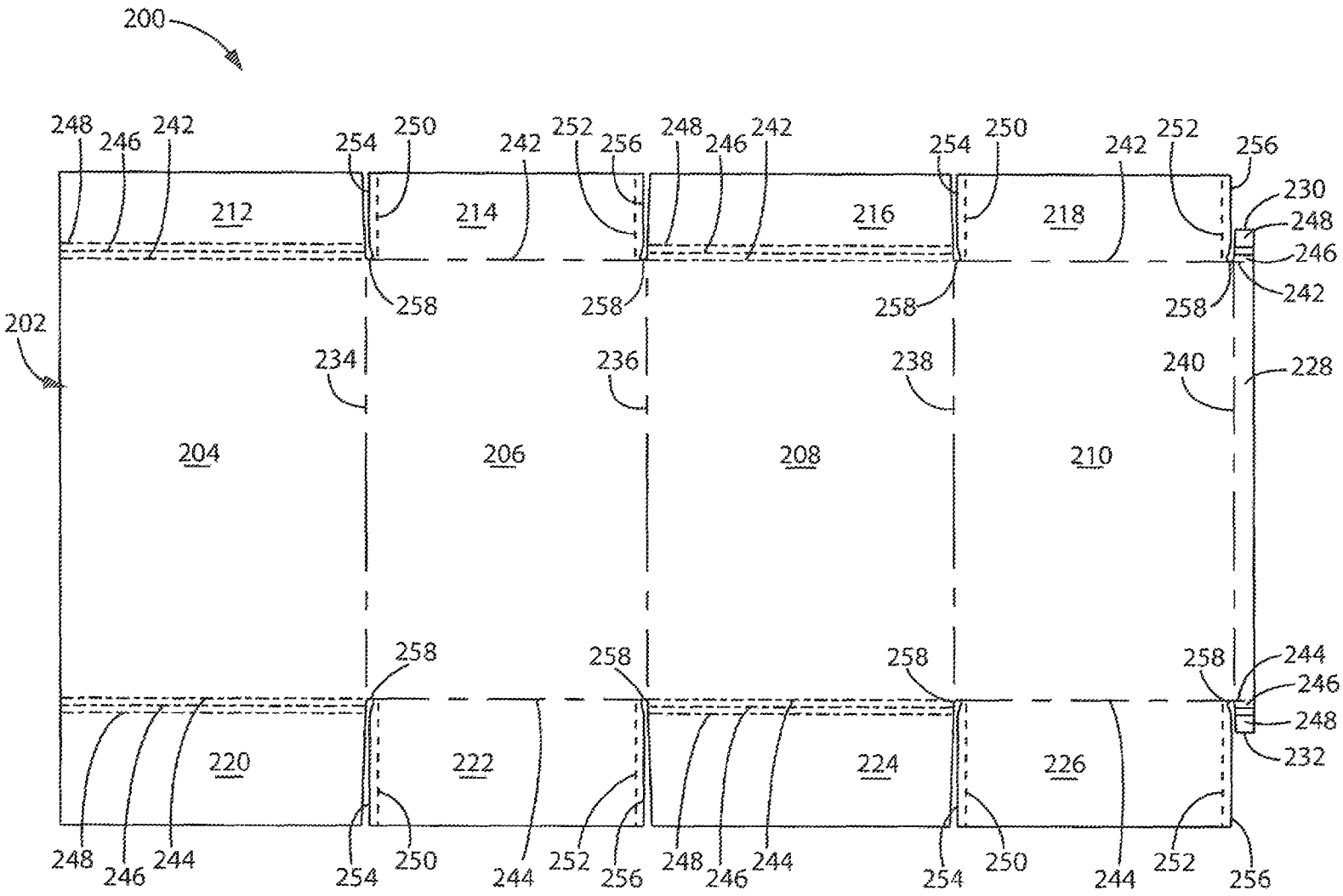
FIG. 5 is a top plan view of an unfolded blank of a container, according to the first alternative embodiment of the present invention.

Turning now to FIGS. 5-9 and initially FIG. 5, there is shown a shipping carton 200 according to a second embodiment of the present invention. The shipping carton 200 generally is made of a sheet or blank 202 of packaging material. The packaging material may consist of corrugated board or any similar material suitable for use in shipping container construction. In a manner as is known, the corrugated board consists of a fluted corrugated core located between two sheets of kraft paper or linerboard, in a manner as is known. In one embodiment the flutes of the inner core have a longitudinal axis that is parallel to the longitudinal axis of the folded and erected carton 200. The blank 202 may be stamped or cut from a sheet of the packaging material while in a substantially flat orientation, and subsequently folded to form the carton 200. The outer surface of the carton 200 may be printed to display information such as contents details, shipping information, removal instructions, orientation indicia and the like. The outer surface of the carton 200 may also contain advertising information or ornamental elements.

FIG. 1 illustrates the blank 202, formed of a single piece of packaging material, in a flat orientation. The blank 202 includes primarily a first side panel 204, a front panel 206, a second side panel 208 and a rear panel 210. Each of these four panels 204, 206, 208, 210 also includes respective individual top panels 212, 214, 216, 218 and individual bottom panels 220, 222, 224, 226 extending from the top and bottom of each corresponding panel 204, 206, 208, 210. Lastly, the rear panel 210 also includes a fixation panel 228, extending from a side of the rear panel 210 between the top panel 218 and bottom panel 226. As illustrated in FIG. 5, the fixation panel 228 may have a small top panel 230 and bottom panel 232 extending from the top and bottom of the fixation panel 228, in line with the other top panels 212, 214, 216, 218 and bottom panels 220, 222, 224, 226 respectively.

Still referring to FIG. 5, the first side panel 204 is hingedly attached to the front panel 206 about a crease line 234. The opposing side of the front panel 206 is hingedly attached to the second side panel 208 about a crease line 236. The opposing side of the second side panel 208 is hingedly attached to the rear panel 210 about a crease line 238, and the opposing side of the rear panel 210 is hingedly attached to the fixation panel 228 about a crease line 240. As illustrated in FIG. 5, the crease lines 234, 236, 238, 240 are parallel in orientation, allowing the panels 204, 206, 208, 210, 228 to be folded into a cuboid carton 200 as is described in further detail below.

In addition to the above indicated side crease lines 234, 236, 238, 240 the blank 202 also includes a top crease line 242 and a bottom crease line 244. The top crease line 242 extends along the upper side or edge of each panel 204, 206, 208, 210, 228 and hingedly attaches the top panels 212, 214, 216, 218, 230 respectively thereto. Similarly, the bottom crease line 244 extends along the lower side or edge of each panel 204, 206, 208, 210, 228 and hingedly attaches the bottom panels 220, 222, 224, 226, 232 respectively thereto. The top and bottom crease lines 242, 244 are each formed of a continuous crease that extends the entire length of the blank 202, and form upper and lower edges of the erected carton 200, when folded. While the lines 234, 236, 238, 204, 242, 244 have been described as "crease lines", it is well within the scope of the invention that these lines may be formed of other methods, including but not limited to scoring or perforating.

Still referring to FIG. 5, the top and bottom panels 212, 214, 216, 218, 220, 222, 224, 226, 230, 232 will be described in further detail. As illustrated in FIG. 5, the top and bottom panels 212, 216, 220, 224 of the first and second side panels 204, 208, respectively, include first and second crumple zone crease lines 246, 248. The crumple zone crease lines 246, 248 are located adjacent the respective crease lines 242, 244 and on the surface of the top or bottom panel 212, 214, 216, 218, 220, 222, 224, 226, 230, 232. In the illustrated embodiment, the first crumple zone crease line 246 may be located approximately between 0.5 and 1.0 inches from the respective top or bottom crease line 242, 244 and approximately 0.75 inches from the respective top or bottom crease line 242, 244. In this illustrated embodiment, the second crumple zone crease line 248 may be located approximately between 0.5 and 1.0 inches from the first crumple zone crease line 246, and approximately 0.75 inches from the first crumple zone crease line 246. While the crumple zone crease lines 246, 248 have been described as "crease lines", it is well within the scope of the invention that these lines 246, 248 may be formed of other methods, including but not limited to scoring or perforating.

The top and bottom panels 214, 218, 222, 226 of the front and rear panels 206, 210, may also include respective first and second crumple zone crease lines 250, 252, which are positioned to correspond with the crumple zone crease lines 246, 248 of the side panels 204, 208 when the blank 202 is folded into a carton 200. The crumple zone crease lines 250, 252 are located adjacent the opposing sides 254, 256 of the top and bottom panels 214, 218, 222, 226 on the surface of the top or bottom panel 214, 218, 222, 226. The crumple zone crease lines 250, 252 are also positioned approximately perpendicular to the crease lines 242, 244. In the illustrated embodiment, crumple zone crease line 250 may be located approximately between 0.75 and 1.5 inches from the first side 254 of the panel 214, 218, 222, 226, and approximately 1.1875 inches from the first side 254 of the respective panel 214, 218, 222, 226. Similarly, crumple zone crease line 252 may be located approximately between 0.75 and 1.5 inches from the second side 256 of the panel 214, 218, 222, 226, and approximately 1.1875 inches from the first side 254 of the respective panel 214, 218, 222, 226. As also illustrated in FIG. 5, the first and second sides 254, 256, of the top and bottom panels 214, 218, 222, 226 may include a taper or void 258 configured to facilitate folding blank 202 into carton 200 and crumpling of the crumple zone crease lines 246, 248, 250, 252. Again, while the crumple zone crease lines 250, 252 have been described as "crease lines", it is well within the scope of the invention that these lines 250, 252 may be formed of other methods, including but not limited to scoring or perforating.

Figure 6:
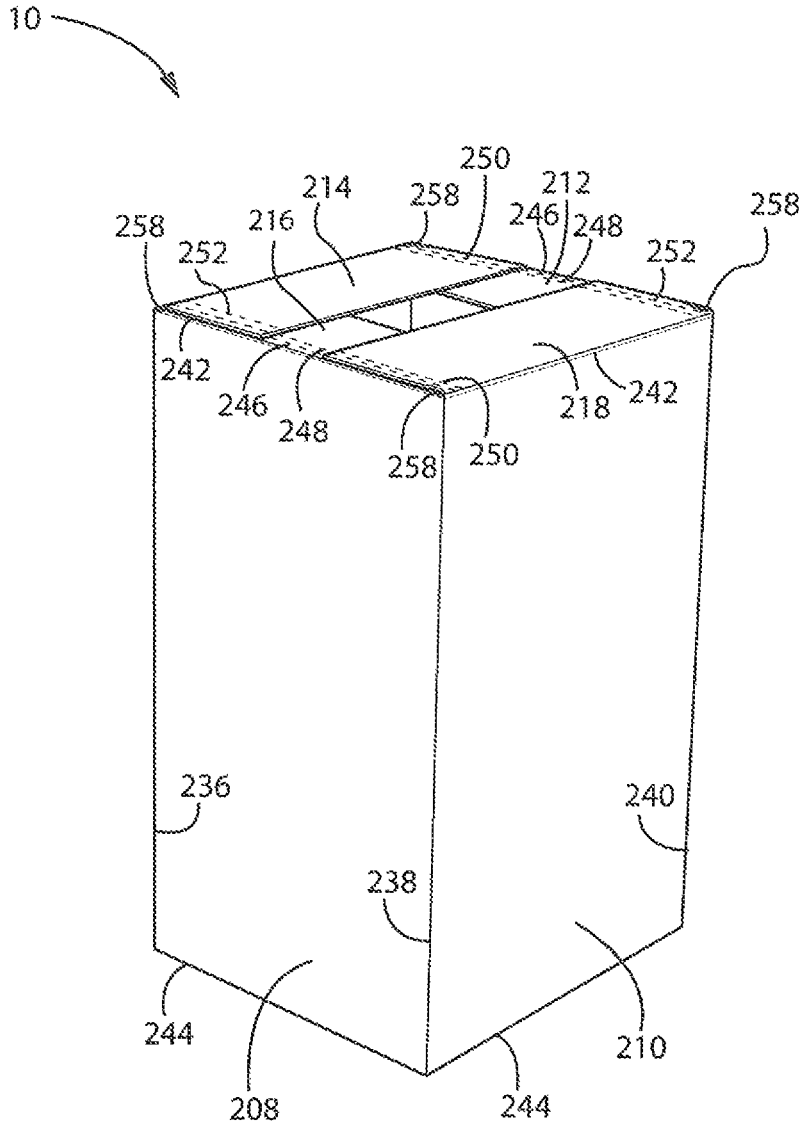
FIG. 6 is a perspective view of a folded container that is formed using the blank of FIG. 5 showing the container in a closed configuration.
Figure 8:
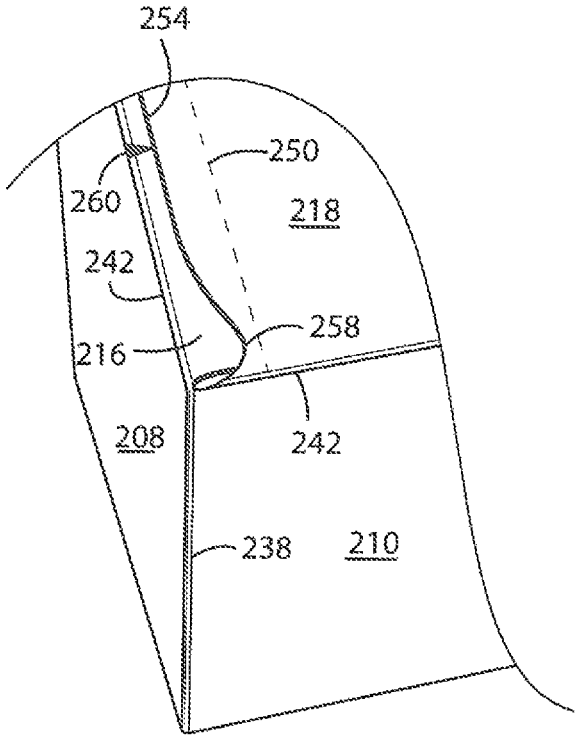
FIG. 8 is a detail perspective view of a corner of the folded container of FIG. 6 showing the container in a closed configuration prior to receiving an inwardly directed force.

Turning now to FIGS. 6 and 8, the blank 202 will be described in a folded and erected configuration to form carton 200. The blank 202 is folded approximately 90 degrees around the score lines 234, 236, 238, 240 until the outer surface of fixation panel 228 overlaps with the inner surface of the first side panel 204. The blank 202 is then retained in this folded configuration by means of applying adhesive between the outer surface of fixation panel 228 and the inner surface of the first side panel 204. Alternatively, the fixation panel 228 and first side panel 204 may be retained in their folded configuration by means of fasteners such as staples, adhesive tape or any other known means of fixation. The bottom panels 220, 222, 224, 226, 232 are then folded inwardly, approximately 90 degrees around crease line 244 respectively to form a base of support on which the carton 200 rests. Once the bottom panels 220, 222, 224, 226, 232 have been folded they may be adhesively or alternatively fixed together to form an integrated base. As shown in FIG. 6 the outer surfaces of bottom panels 222, 226 may be adhesively affixed to the inner surfaces of bottom panels 220, 224; or alternatively the outer surfaces of bottom panels 220, 224 may be adhesively affixed to the inner surfaces of the bottom panels 222, 226. After the bottom has been formed, an appliance or other object may be inserted into the interior cavity formed within the carton 200. Corner posts and or other packaging materials may also be inserted into the carton 200, surrounding the appliance, as previously illustrated in FIG. 3. Once all of the contents have been placed into the carton 200, the top panels, 212, 214, 216, 218, 230 may be folded inwardly, approximately 90 degrees around crease line 242 respectively to form a top to the carton 200 and adhesively or alternatively fixed together. As shown in FIG. 6 the inner surfaces of top panels 214, 218 may be adhesively affixed to the outer surfaces of top panels 212, 216; or alternatively the inner surfaces of top panels 212, 216 may be adhesively affixed to the outer surfaces of the top panels 214, 218.

Figure 7:
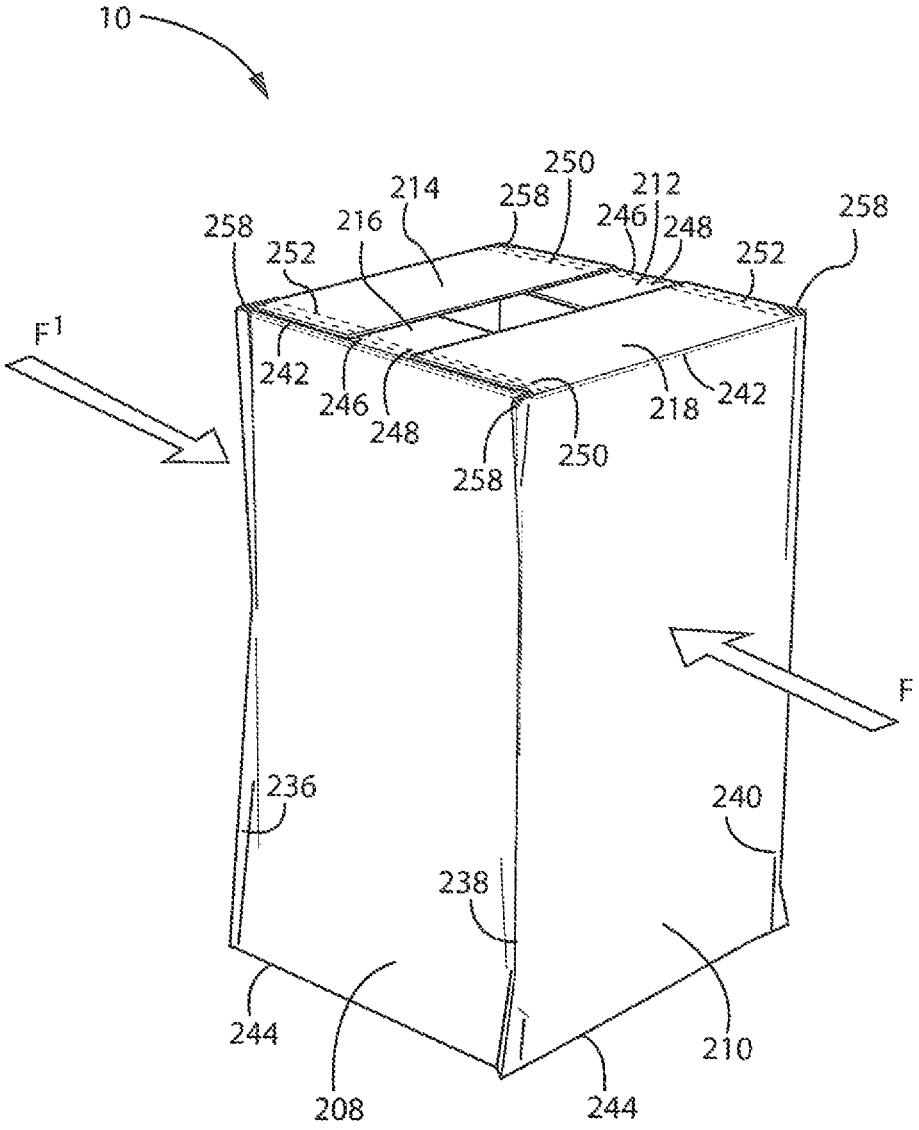
FIG. 7 is a perspective view of the folded container of FIG. 6 showing the container in a closed configuration receiving an inwardly directed lateral force on opposing side walls, such as is experienced during clamping-type load handling, resulting in a controlled crumpling at select positions along the container walls and buckling of the container top and bottom.
Figure 9:
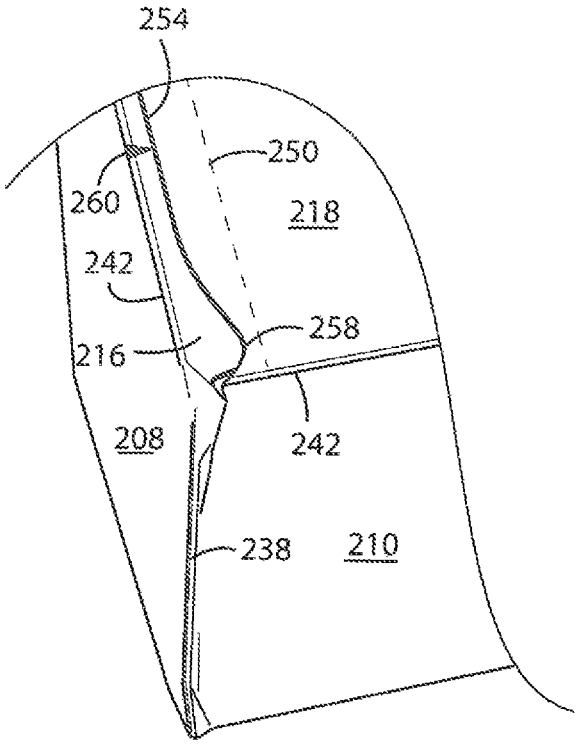
FIG. 9 is a detail perspective view similar to FIG. 8 showing the container in a closed configuration after receiving an inwardly directed force.

Turning now to FIGS. 7 and 9, once the carton 200 has been retained in its folded configuration described above, it may be subjected to opposing lateral forces such as those exerted by a clamp lift and indicated by arrows F, F'. When subjected to such forces, the front and rear panels 206, 210 may be forced inwards, in the direction indicated by arrows F. F'. In response to such inward movement of the front and rear panels 206, 210, the forces applied to front and rear panels 206, 210 are transferred to the weakened crumple zone crease lines 246, 248, 250, 252 rather than to the upper and lower corners between first and second side panels 204, 208 and the top and bottom of carton 200. This avoids buckling at the top and bottom corners of first and second side panels 204, 208 and instead results in upward and downward flexing, bending, and movement at the crumple zone crease lines 246, 248, 250, 252 at the top and bottom of the carton 10, respectively.

Still referring to FIGS. 7 and 9, the crumple zone crease lines 246, 248, 250, 252 are illustrated in a crumpled configuration in which a lateral force F' has forced the rear panel 210 inwards, resulting in the flexing or bending of the crumple zone crease lines 246, 248, 250, 252 which absorb or receive the force F' and thereby limit the carton 200 from undesirably and uncontrollably creasing or bending in other locations. The inward movement of the rear panel 210 at its intersection with top panel 218 is accommodated by the enlarged void area 258 of slot 260, which acts as a relief to insure that lateral movement of the upper end of rear panel 210 does not result in application of a lateral force to the top corner of carton 200. That is, the presence of the crumple zone crease lines 246, 248, 250, 242 will localize any potential creasing of carton 200 to the area of the carton 200 that is in the approximate vicinity of the crumple zone crease lines 246, 248, 250, 252. By way of localizing the potential creasing of carton 200, as is illustrated in FIGS. 7 and 9, the first and second side panels 204, 208 do not exhibit creasing or alternative damage, particularly around the center or middle of the carton 200. As a result, the carton 200 has an improved esthetic appearance after shipment. Additionally, by localizing any potential creasing or carton 200 to an area adjacent a corner post, the present invention greatly reduces the risk of abrading, scratching and chipping the finish of the appliance or denting the appliance body.

III. Embodiment Three

Figure 10:
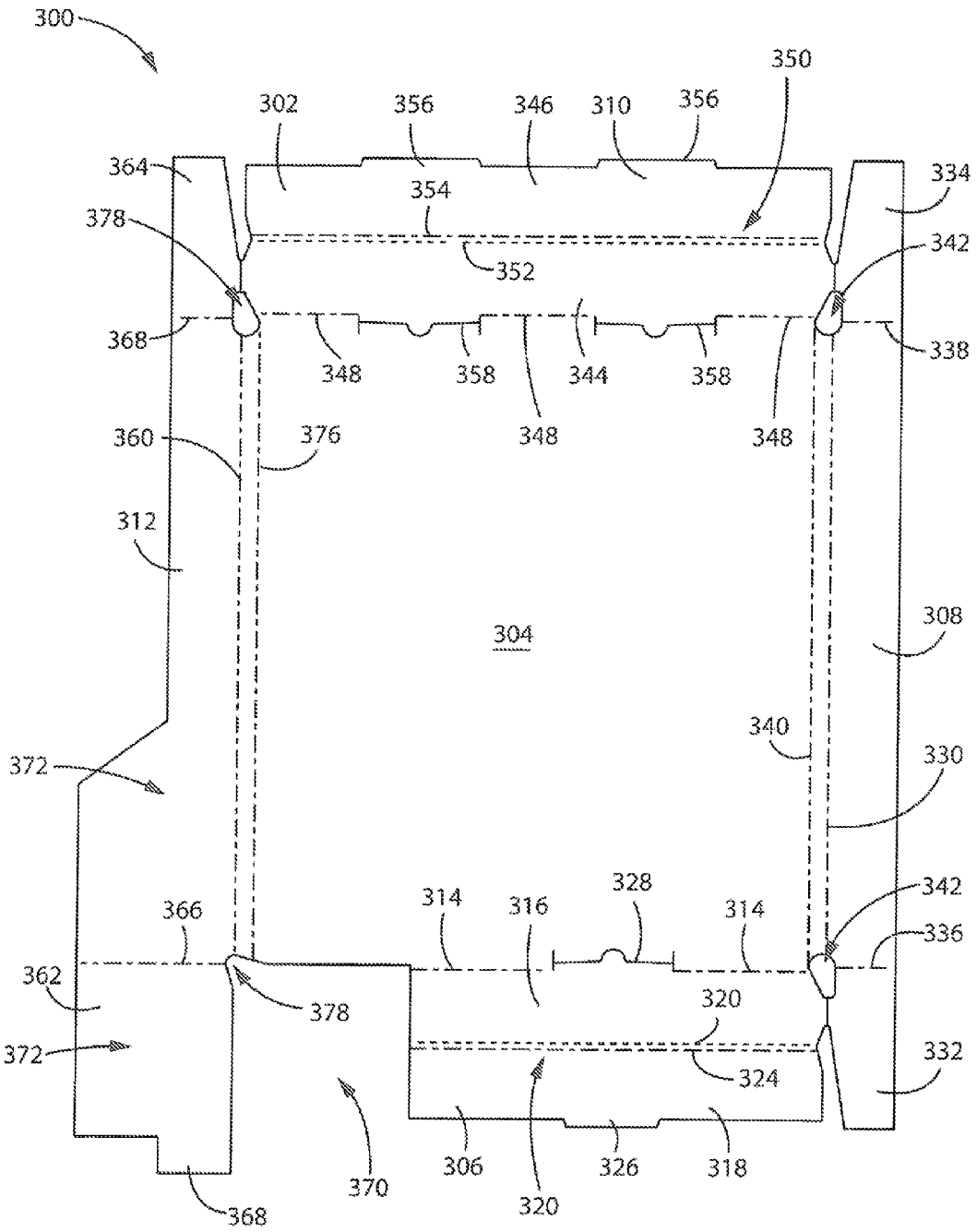
FIG. 10 is a top plan view of an unfolded blank of a top or bottom panel or cap of a shipping container, according to the second alternative embodiment of the present invention.
Figure 11:
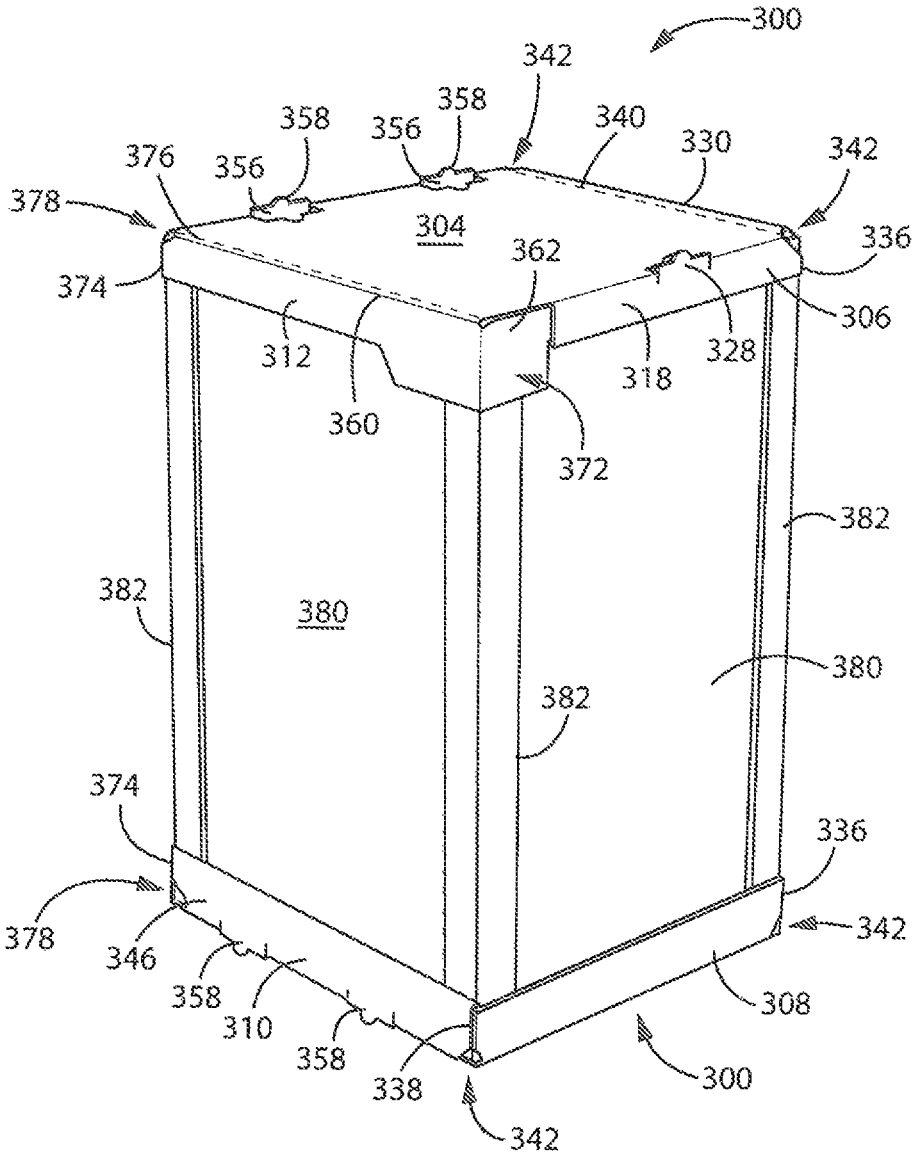
FIG. 11 is a perspective view of an appliance to which top and bottom caps are secured, wherein each cap is formed from a folded blank of FIG. 10, and including a plurality of corner posts between the top and bottom caps.

Turning now to FIGS. 10 and 11 and initially FIG. 10, there is shown a shipping carton cap 300 according to another embodiment of the present invention. The shipping carton cap 300 generally is made of a sheet or blank 302 of packaging material. The packaging material may consist of corrugated board or any similar material suitable for use in shipping container construction. In a manner as is known, the corrugated board consists of a fluted corrugated core located between two sheets of kraft paper or linerboard, in a manner as is known. In one embodiment the flutes of the inner core have a longitudinal axis that is parallel to the longitudinal axis of the folded and erected carton cap 300. The blank 302 may be stamped or cut from a sheet of the packaging material while in a substantially flat orientation, and subsequently folded to form the carton cap 300. The outer surface of the carton cap 300 may be printed to display information such as contents details, shipping information, removal instructions, orientation indicia and the like. The outer surface of the carton cap 300 may also contain advertising information or ornamental elements.

FIG. 10 illustrates the blank 302, formed of a single piece of packaging material, in a flat orientation. The blank 302 includes primarily a center panel 304, and four edge panels extending therefrom; namely, a front panel 306, a first side panel 308, a rear panel 310 and a second side panel 312. Each of these four edge panels 306, 308, 310 and 312 is hingedly attached to the sides of the center panel 304 about a crease line 314, which also defines the edge of the center panel 304.

Still referring to FIG. 10, the front panel 306 is formed in part from a double layer of packaging material, and is formed from a first front panel section 316 and a second front panel section 318. The first front panel section 316 is located between the center panel 304 and the second front panel section 318. On one side, the first front panel section 316 is hingedly attached to the side of the center panel 304 about a crease line 314 while on the opposing side the first front panel section 316 is hingedly attached to the second front panel section 318 about a crease line 320. In one embodiment of the present invention, as shown in FIG. 10, the crease line 320, which divides the first and second front panel sections 316, 318, includes a first crease line 322 and a second crease line 324 wherein the first and second crease lines 322, 324 are slightly offset such that when the first and second front panel sections 316, 318 are rotated approximately 180 degrees about the crease line 320 a void or space is left between the two panel sections 316, 318. As will be described in further detail below, the void or space left between the two panel sections 316, 318 as a result of the two crease lines 322, 324 will accommodate portions of the first and second side panels 308, 312 therein when the blank 302 is in the folded configuration. Additionally, the second front panel section 318 includes a outwardly protruding tab 326, which is configured to be received within a slot 328 that intersects the crease line 314 when the first and second front panel sections 316, 318 are rotated approximately 180 degrees about the crease line 320, as to lock the front panel 306 in its folded configuration. While the crease lines 314, 320, 322, 324 have been described as "crease lines", it is well within the scope of the invention that these lines 314, 320, 322, 324 may be formed of other methods, including but not limited to scoring or perforating.

Still referring to FIG. 10, the first side panel 308 is formed from a single layer of packaging material hingedly attached to the center panel 304 about a crease line 330, and includes a first locking tab 332 and second locking tab 334 extending from the first side panel 308 in opposing directions. Specifically, the first locking tab 332 is located adjacent the front panel 306, and is hingedly attached to the first side panel 308 about a crease line 336, which is a continuation of the crease line 314 that divides the center panel 304 from the front panel 306. In this arrangement, rotation of the first side panel 308 about the crease line 330 combined with rotation of the first locking tab 332 about the crease line 336 will allow the first locking tab 332 to be positioned within the void or space left between the two panel sections 316, 318 of the front panel 306. That is to say that the front panel 306 and first side panel 308 will form an approximately 90 degree angle by way of retaining the first locking tab 332 between the two panel sections 316, 318.

On the opposing end of the first side panel 308, the second locking tab 334 is similarly located adjacent the rear panel 310, and is hingedly attached to the first side panel 308 about a crease line 338, which is a continuation of the crease line that divides the center panel 304 from the rear panel 310. As will be described in further detail below, rotation of the first side panel 308 about the crease line 330 combined with rotation of the second locking tab 334 about the crease line 338 will allow the second locking tab 334 to be positioned between the two sections of the rear panel 310, thereby forming an approximately 90 degree angle by way of retaining the second locking tab 334 within the rear panel 310.

Additionally, the first side panel 308 includes a crumple zone crease line 340 which extends from two voids 342, located at opposing ends of the crease line 330, and which are configured to facilitate folding blank 302 into carton cap 300 and maintaining localized crumpling of the crumple zone crease line 340. In the illustrated embodiment, crumple zone crease line 340 may be located in the center panel 304 approximately between 0.5 and 4.0 inches from the crease line 330 of the first side panel 308, and approximately 1.5 inches from the first side panel 330.

Still referring to FIG. 10, the rear panel 310 is formed in part from a double layer of packaging material, and is formed from a first rear panel section 344 and a second rear panel section 346. The first rear panel section 344 is located between the center panel 304 and the second rear panel section 346. On one side, the first rear panel section 344 is hingedly attached to the side of the center panel 304 about a crease line 348 while on the opposing side the first rear panel section 344 is hingedly attached to the second rear panel section 346 about a crease line 350. In one embodiment of the present invention, as shown in FIG. 10, the crease line 350, which divides the first and second rear panel sections 344, 346, includes a first crease line 352 and a second crease line 354 wherein the first and second crease lines 352, 354 are slightly offset such that when the first and second rear panel sections 344, 346 are rotated approximately 180 degrees about the crease line 350 a void or space is left between the two panel sections 344, 346. As was previously described, the void or space left between the two panel sections 344, 346 as a result of the two crease lines 352, 254 will accommodate the second locking tab 334 of the first side panel 308 therein along with a portion of the second side panel 312 when the blank 302 is in the folded configuration. Additionally, the second rear panel section 346 includes two outwardly protruding tabs 356, which are configured to be received within slots 358 that intersect the crease line 348 when the first and second rear panel sections 344, 346 are rotated approximately 180 degrees about the crease line 350, so as to lock the rear panel 106 in its folded configuration. While the crease lines 348, 350, 352, 354 have been described as "crease lines", it is well within the scope of the invention that these lines 348, 350, 352, 354 may be formed of other methods, including but not limited to scoring or perforating.

Lastly, the second side panel 312 is formed from a single layer of packaging material hingedly attached to the center panel 304 about a crease line 360, and includes a first locking tab 362 and second locking tab 364 extending from the second side panel 312 in opposing directions. Specifically, the first locking tab 362 is located adjacent the front panel 306, and is hingedly attached to the second side panel 312 about a crease line 366, which is a continuation of the crease line 314 that divides the center panel 304 from the front panel 306. In this arrangement, rotation of the second side panel 312 about the crease line 360 combined with rotation of the first locking tab 362 about the crease line 364 will allow the first locking tab 362, and particularly the end extension 368 to be positioned within the void or space left between the two panel sections 316, 318 of the front panel 306. That is to say that the front panel 306 and second side panel 312 will form an approximately 90 degree angle by way of retaining the end extension 368 of the first locking tab 362 between the two panel sections 316, 318.

The first locking tab 362 of the second side panel 312 differs from its counterpart on the first side panel 308 in part due to its shape. As shown in FIG. 10, the front panel 306 does not extend across the full length of the lower edge of the center panel 304, resulting in a void 370 located adjacent the center panel 304 and front panel 306. The void 370 is configured to allow a single thickness portion of the packaging material, from the first locking tab 362 of the second side panel 312 to extend across the void 370, when the blank 302 is in a folded configuration. The single thickness packaging material located at the first locking tab 362, and extending past the crease line 366 and into the lower portion of the second side panel 312 provides an area 372 for the application of a name plate, product identification information, advertising or other indicia to be applied to the carton cap 300, while allowing the name plate or other indicia to remain flush relative to the dual thickness packaging material of the front panel 306.

Continuing onto the opposing end of the second side panel 312, the second locking tab 364 is similarly located adjacent the rear panel 310, and is hingedly attached to the second side panel 312 about a crease line 374, which is a continuation of the crease line 348 that divides the center panel 304 from the rear panel 310. As was previously described, rotation of the second side panel 312 about the crease line 360 combined with rotation of the second locking tab 364 about the crease line 374 will allow the second locking tab 364 to be positioned between the two sections 344, 346 of the rear panel 310, thereby forming an approximately 90 degree angle by way of retaining the second locking tab 364 within the rear panel 310.

Additionally, the first side panel includes a crumple zone crease line 376 which extends from two voids 378, located at opposing ends of the crease line 360, and which is configured to facilitate folding blank 302 into carton cap 300 and maintaining localized crumpling of the crumple zone crease line 376. In the illustrated embodiment, crumple zone crease line 376 may be located in the center panel 304 approximately between 0.5 and 4.0 inches from the crease line 360 of the second side panel 312, and approximately 1.5 inches from the second side panel 312.

Turning now to FIG. 11, the blank 302 will be described in a folded and erected configuration to form carton cap 300. The blank 302 is folded approximately 90 degrees around the crease lines 314, 330, 348, 360. The locking tabs 332, 334, 362, 364 of the first and second side panels 308, 312 are then folded approximately 90 degrees until they engage the first sections 316, 344 of the front and rear panels 306, 310 respectively. The second sections 318, 346 of the front and rear panels 306, 310 are then folded approximately 180 degrees about their crease lines 320, 350, respectively. When fully folded the tabs 326, 356 of the front and rear panels 306, 310 are received within the corresponding slots 328, 358, with the locking tabs 332, 334, 362, 264 held securely between the two sections of the front and rear panels 306, 310, respectively. In this configuration the carton cap 300 is held in a folded configuration without the need for adhesive or any other fixation means.

As shown in FIG. 11, the bottom and top caps of the appliance packaging are formed from two identical carton caps 300. After the bottom carton cap 300 has been formed, an appliance 380 or other object may be inserted into the interior cavity formed within the bottom carton cap 300. Corner posts 382 and or other packaging materials may also be inserted into the bottom carton cap 300, surrounding the appliance 380. Once all of the contents have been placed into the bottom carton cap 300, the top carton cap 302 is placed on top of the appliance 380 and corner posts 382. The top and bottom carton caps 302, appliance 380, corner posts 382 and any additional packaging material are then stretch or shrink wrapped or alternatively fixed together.

Once the carton cap 300 has been retained in its folded configuration described above, it may be subjected to opposing lateral forces such as those exerted by a clamp lift and previously discussed in the preceeding embodiments. When subjected to such forces, the first and second side panels 308, 312 may be forced inwards. In response to such inward movement of the first and second side panels 308, 312, the forces applied to first and second side panels 308, 312 are transferred to the weakened crumple zone crease lines 340, 376 rather than to the upper and lower corners between front and rear panels 306, 310 at the top and bottom carton caps 300. This avoids buckling at the top and bottom corners of front and rear panels 306, 310 and instead results in upward and downward flexing, bending, and movement at the crumple zone crease lines 308, 312 at the top and bottom of the carton cap 300, namely the center panel 302, respectively.

Although specific embodiments are illustrated and discussed above, it is understood that the size and shape of the carton 100, 200, 300 may vary greatly to accommodate the size and shape of the appliance or other device contained within the carton 100, 200, 300. While the figures have illustrated carton 100, 200, 300 approximately configured to receive a conventional consumer appliance, larger or smaller cartons 100, 200, 300 are considered well within the scope of the present invention. In this regard, carton 100, 200, 300 for other home appliances, furniture, or electronics are within the scope of this invention. Similarly, any number, location, variation or combination in the multiple styles of panels and crumple zone crease lines described herein is considered within the scope of the present invention.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

I claim:

1. A packaging arrangement for an article such as an appliance having a pair of ends and a series of sides extending therebetween, wherein the packaging arrangement includes at least a pair of end packaging structures for enclosing the ends of the article, wherein each end packaging structure comprises:

a series of side walls and at least one end panel, wherein a series of end edges are defined between each side wall and the at least one end panel, and wherein a series of side edges are defined between the series of side walls, wherein a corner is defined at a location where a pair of end edges and one of the side edges come together;

a first crumple zone at each corner, wherein the first crumple zone comprises a transversely extending linear weakened buckle-inducing structure in the end panel spaced inwardly from and extending generally parallel to a first one of the end edges defining the corner, wherein the weakened buckle-inducing structure deforms outwardly upon application of a compressive force to the side wall defining the first end edge; and a second crumple zone at each corner, wherein the second crumple zone comprises a plurality of spaced apart weakened collapse-inducing structures in the second one of the end edges defining the corner and spaced inwardly from the corner, wherein the collapse-inducing structures collapse the second end edge and accommodate inward movement of the side wall defining the first end edge upon application of the compressive force to the side wall defining the first end edge.

2. The packaging arrangement of claim 1, wherein the external force is applied at an angle approximately parallel to a plane defined by each end panel.

3. The packaging arrangement of claim 1, wherein the article defines a series of corners, and wherein the packaging arrangement further includes a corner support member located outwardly of each corner of the article.

4. A packaging arrangement comprising first and second end caps, wherein each end cap is constructed as set forth in claim 1.

5. The packaging arrangement of claim 4, wherein the first and second end caps are configured to receive the article and a plurality of support members therein, wherein the support members are located about the article and extend between the end caps.

6. The packaging arrangement of claim 1, wherein the weakened buckle-inducing structure comprises a crease line formed in the end panel and extending generally parallel to the first end edge defining the corner.

7. The packaging arrangement of claim 1, wherein the end panel comprises a series of end flaps, wherein the weakened buckle-inducing structure is formed in the end flap.

8. The packaging arrangement of claim 1, wherein the plurality of spaced apart weakened collapse-inducing structures in the second one of the end edges comprises a plurality of spaced-apart perforations formed in the top panel and in the side wall defining the second end edge.

9. The packaging arrangement of claim 1, wherein the series of side walls extend between and interconnect the pair of end packaging structures, and wherein each end panel is defined by a series of overlapping end flaps that are foldably connected to and extend from the series of side walls.

10. A packaging arrangement for an article such as an appliance having a pair of ends and a series of sides extending therebetween, wherein the packaging arrangement includes at least a pair of end packaging structures for enclosing the ends of the article, wherein each end packaging structure comprises:

a series of side walls and at least one end panel, wherein a series of end edges are defined between each side wall and the at least one end panel, and wherein a series of side edges are defined between the series of side walls, wherein a corner is defined at a location where a pair of end edges and one of the side edges come together;

a first crumple zone at each corner, wherein the first crumple zone comprises a transversely extending linear weakened buckle-inducing structure in the end panel spaced inwardly from and extending generally parallel to a first one of the end edges defining the corner, wherein the weakened buckle-inducing structure deforms outwardly upon application of a compressive force to the side wall defining the first end edge; and a second crumple zone at each corner, wherein the second crumple zone comprises a void area in the second one of the end edges defining the corner and extending inwardly from the corner, wherein the void area collapses the second end edge and accommodates inward movement of the side wall defining the first end edge upon application of the compressive force to the side wall defining the first end edge.

11. The packaging arrangement of claim 10, wherein the weakened buckle-inducing structure comprises a crease line formed in the end panel and extending generally parallel to the first end edge defining the corner.

12. The packaging arrangement of claim 10, wherein the end panel comprises a series of end flaps, wherein the weakened buckle-inducing structure is formed in the end flap.

13. The packaging arrangement of claim 10, wherein the end panel comprises a series of end flaps, and wherein the void area is defined between each end flap and the side wall defining the first end edge.

14. A packaging arrangement comprising first and second end caps, wherein each end cap is constructed as set forth in claim 10.

15. The packaging arrangement of claim 14, wherein the first and second end caps are configured to receive the article and a plurality of support members therein, wherein the support members are located about the article and extend between the end caps.

16. The packaging arrangement of claim 10, wherein the series of side walls extend between and interconnect the pair of end packaging structures.

* * * * *